US005896711A

United States Patent [19]

McClure

[11] Patent Number: 5,896,711

[45] Date of Patent: Apr. 27, 1999

[54] ROOF CURB

[75] Inventor: Richard R. McClure, Bashor, Kans.

[73] Assignee: Butler Manufacturing Company, Inc., Kansas City, Mo.

[21] Appl. No.: 08/920,895

[22] Filed: Aug. 29, 1997

[51] Int. Cl.[6] ..... E40B 7/02

[52] U.S. Cl. ..... 52/200; 52/199; 52/198; 52/58; 52/537

[58] Field of Search ..... 52/200, 58, 537, 52/198, 199, 219; 454/199, 366

[56] References Cited

U.S. PATENT DOCUMENTS

| | | | |
|---|---|---|---|
| 364,304 | 6/1887 | Sagendorph | 52/58 |
| 2,703,060 | 3/1955 | Kiefer | 52/200 |
| 3,579,930 | 5/1971 | Murphy | 52/219 |
| 4,413,450 | 11/1983 | Brower | 52/200 |
| 4,603,517 | 8/1986 | Lyons, Jr. | 52/60 |
| 4,825,608 | 5/1989 | Makin | 52/200 |
| 4,890,426 | 1/1990 | Hickman et al. | 52/58 |
| 5,016,406 | 5/1991 | Calam et al. | 52/200 |
| 5,027,576 | 7/1991 | Gustavsson | 52/748 |
| 5,077,943 | 1/1992 | McGady | 52/58 |
| 5,402,611 | 4/1995 | Vagedes | 52/198 |
| 5,454,538 | 10/1995 | Merideth | 248/237 |
| 5,522,189 | 6/1996 | Mortensen et al. | 52/58 |
| 5,561,952 | 10/1996 | Damron | 52/198 |
| 5,675,940 | 10/1997 | Bahar | 52/58 |
| 5,687,514 | 11/1997 | Gillispie | 52/58 |
| 5,706,610 | 1/1998 | Mayle | 52/58 |
| 5,718,088 | 2/1998 | Jacobsen | 52/58 |

FOREIGN PATENT DOCUMENTS

| | | | |
|---|---|---|---|
| 2443542 | 8/1980 | France | 52/58 |

*Primary Examiner*—Christopher Kent
*Assistant Examiner*—Phi Dieu Tran A
*Attorney, Agent, or Firm*—Shoemaker and Mattare, Ltd.

[57] ABSTRACT

A rectangular curb unit is installed on a sloping standing seam metal roof at an angle to the dip direction, so that water does not accumulate on the upslope side of the curb unit. The curb unit has four side walls, and inserts shaped to conform to the seam geometry are welded to the walls at the seam locations, typically at opposite corners.

3 Claims, 5 Drawing Sheets

ROOF CURB

BACKGROUND OF THE INVENTION

This invention relates to metal roof construction.

Curbs are constructed on metal roofs around skylights and mechanical equipment such as heating or air condition units, to divert rain precipitation around the unit. The curbs are usually constructed as a rectangle whose side walls are parallel to corresponding sides of the roof. Where the roof has a slope, normally the upslope and downslope curbs are perpendicular to the dip of the roof. As a result, water tends to collect along the upslope curb, and may leak past the curb or cause premature corrosion. U.S. Pat. No. 4,413,450, Pat. No. 5,522,189 and Pat. No. 5,027,576 are representative of prior curbs, installed orthogonally on a roof so that the upslope curb is perpendicular to the dip of the roof.

SUMMARY OF THE INVENTION

It is an object of this invention to prevent water from collecting against a curb installed on a sloped roof.

I have realized that a rectangular curb unit can be installed diagonally on a sloped roof to prevent water from collecting along any side wall. A detailed description of how this may be accomplished follows.

BRIEF DESCRIPTION OF THE DRAWINGS

In the accompanying drawings.

DESCRIPTION OF THE PREFERRED EMBODIMENTS

Figure 1:
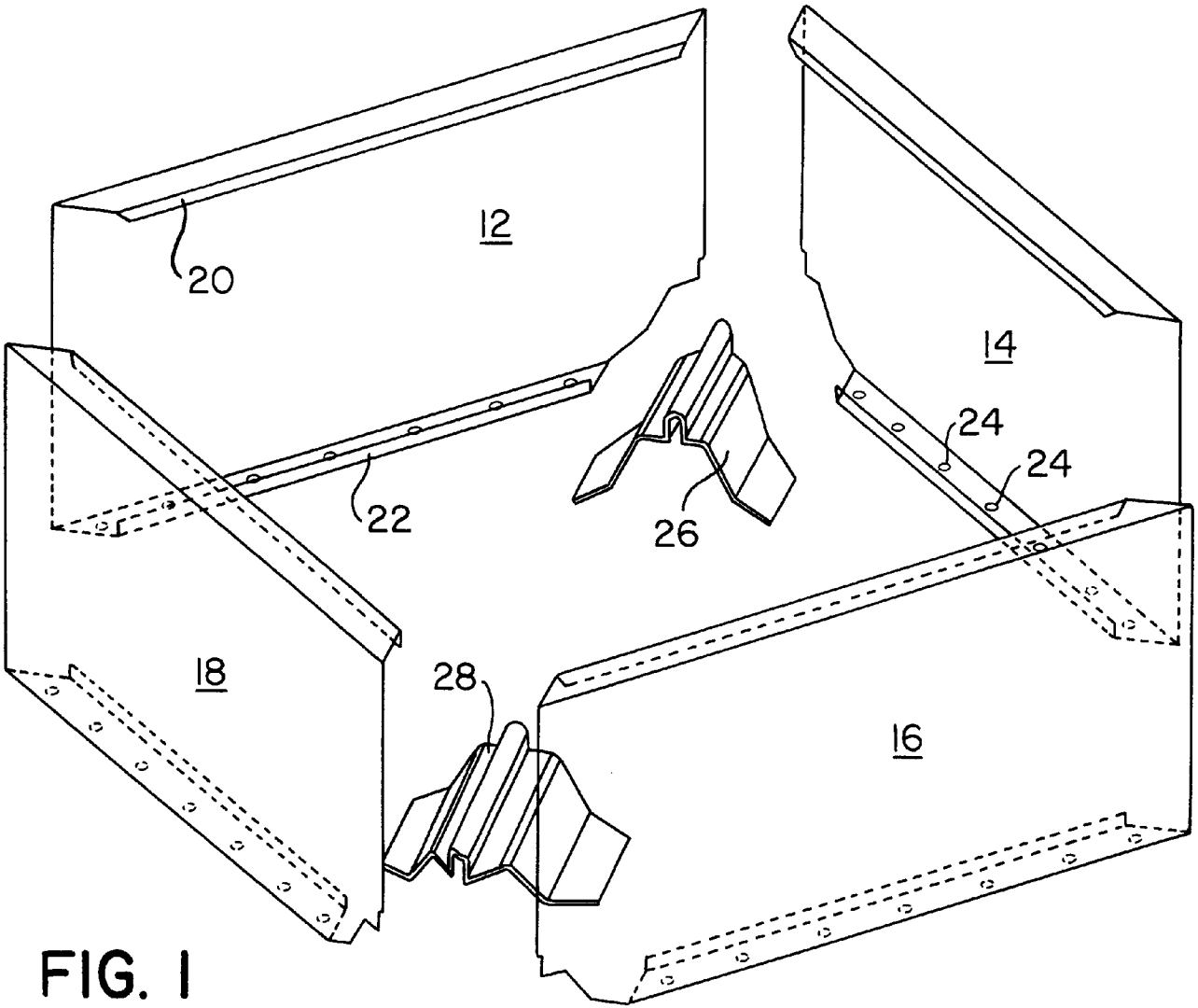
FIG. 1 is an exploded perspective view of a curb unit embodying the invention.

As shown in FIG. 1, a square curb unit embodying the invention comprises four side walls 12, 14, 16 and 18 of equal length and height. The top flange of each is turned down at 20, and the lower flange is turned up at 22. The lower flange is punctuated by a series of bolt holes 24. Items 26 and 28 are inserts shaped to conform to the profile of the corrugations on the metal roof for which the curb unit is intended.

The inserts are, preferably, cut from aluminum extrusions. Those illustrated are intended for use on an MR-24 roof (Butler Manufacturing Company, Kansas City, Mo.). The cross-sectional shape is seen at the cut end of the extrusion, near the numeral 26 in FIG. 1. It includes a central arch intended to just clear a crimped seam between adjacent roof panels, and wings on either side of the arch, each having an inverted "gull wing" profile corresponding to the MR-24 roof's corrugations. The inner end of the insert is cut straight across, while the outer end is cut on two perpendicular planes corresponding to the planes of the side walls. The adjacent bottom corners of the sides are cut to conform to the shape of the bottom edge of each insert.

Figure 2:
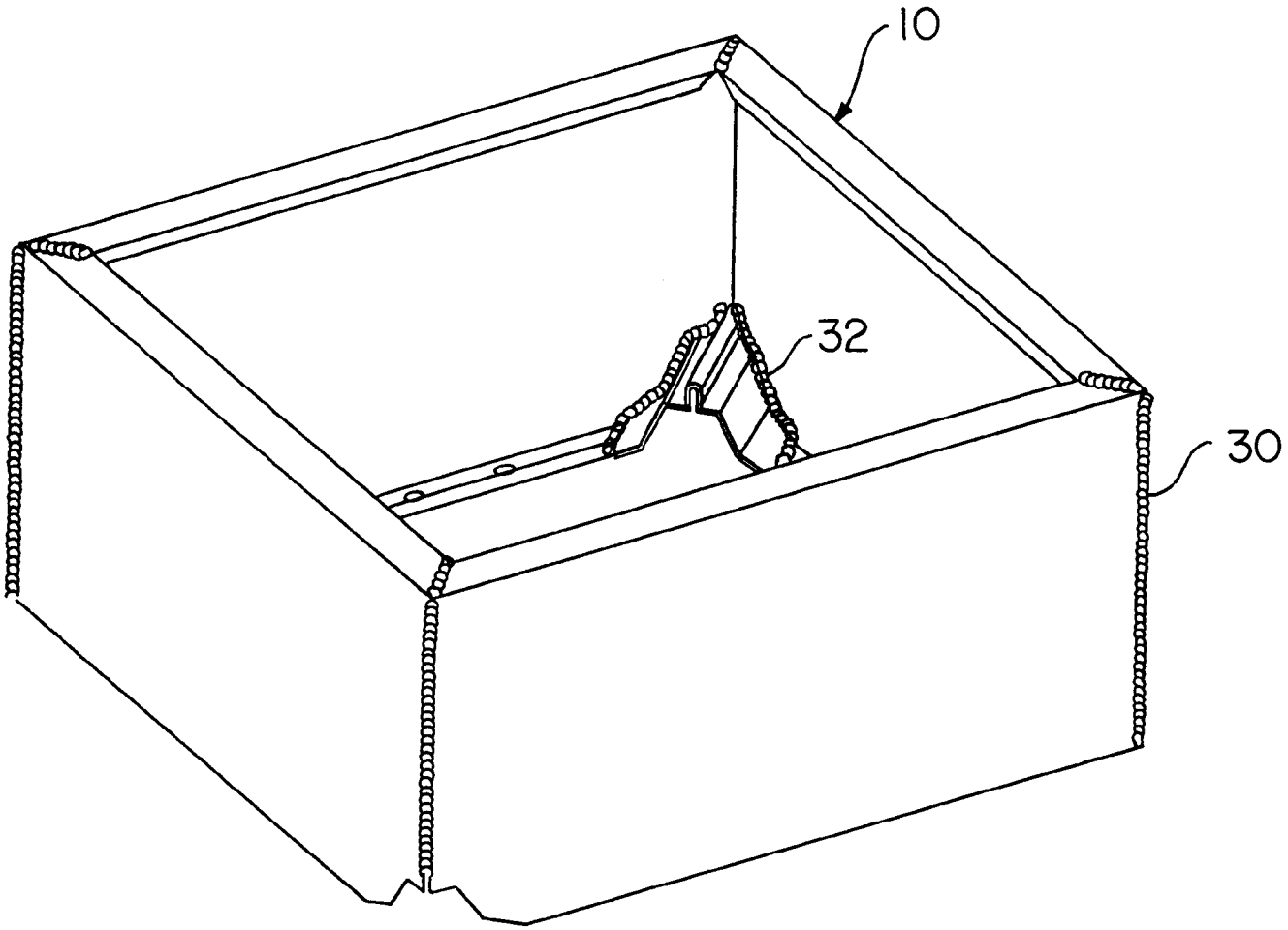
FIG. 2 is an a corresponding view of the curb unit, assembled.

The unit is assembled by welding the corners 30 to form the finished unit shown in FIG. 2. Assembly is preferably done in a factory with precision fixtures, but the curb unit could be built up at the work site if necessary.

Figure 3:
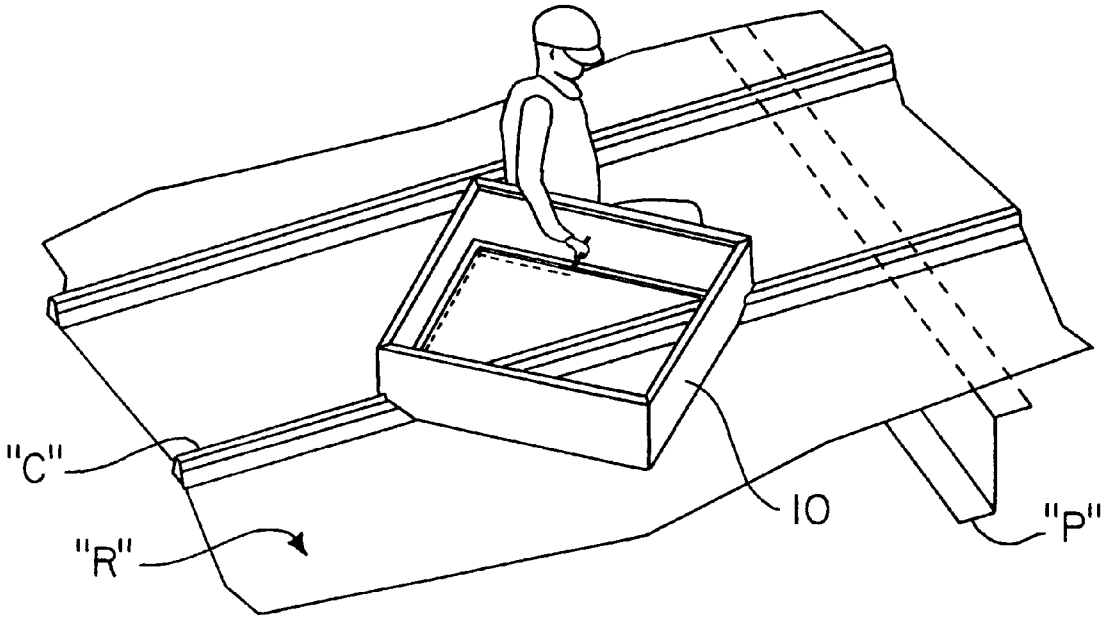
FIG. 3 is shows a worker marking the intended location for the curb on a standing seam roof.
Figure 4:
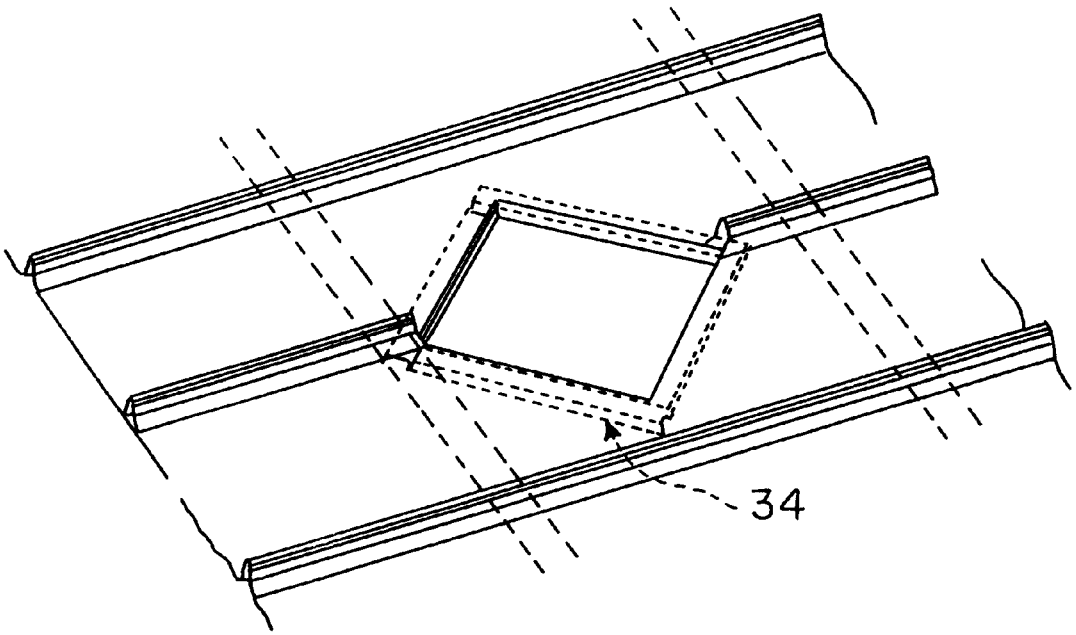
FIG. 4 shows a hole which has been cut in the roof, and reinforced.
Figure 5:
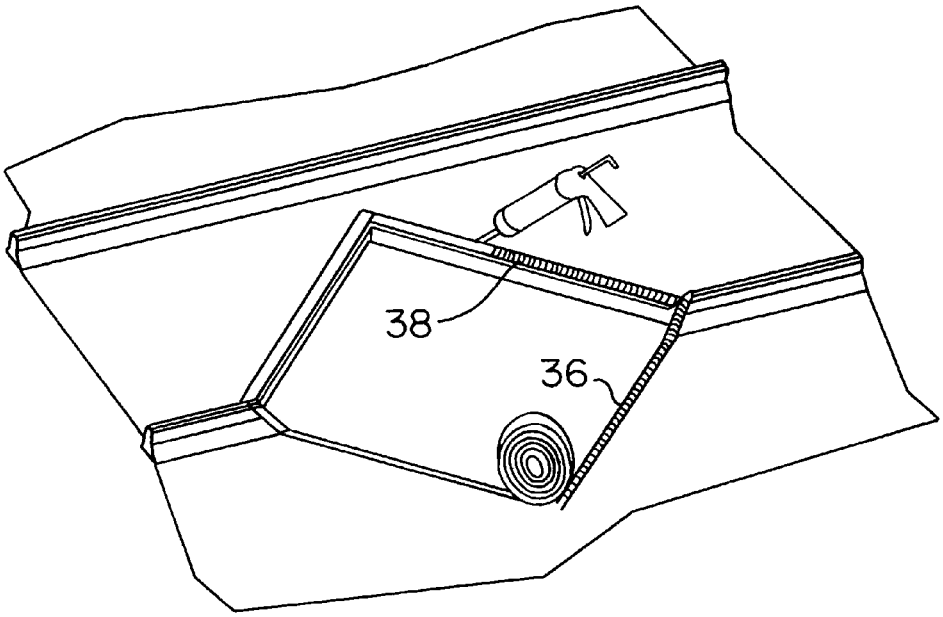
FIG. 5 shows weather seal being applied around the hole.
Figure 6:
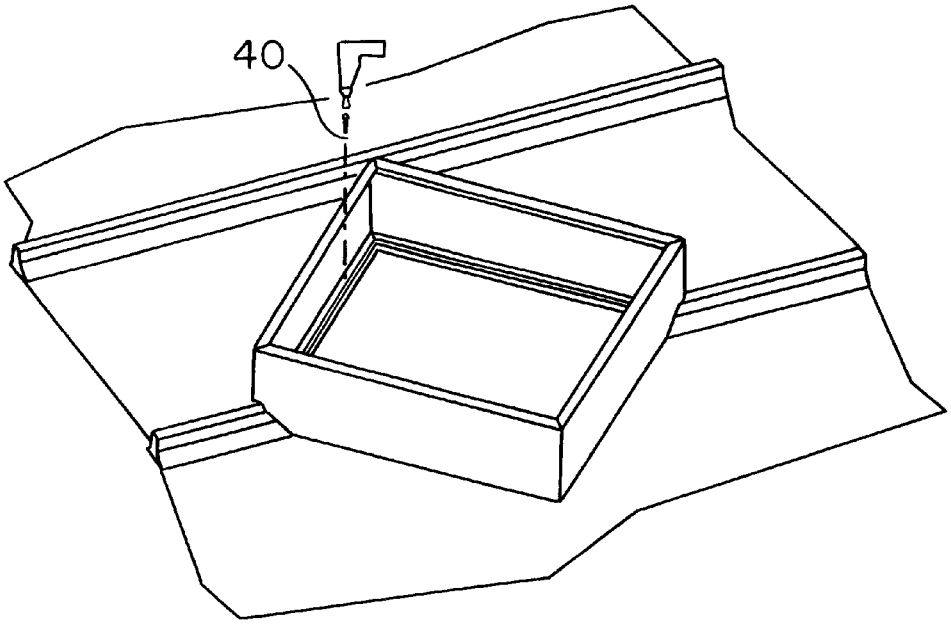
FIG. 6 shows the curb being installed over the hole.
Figure 7:
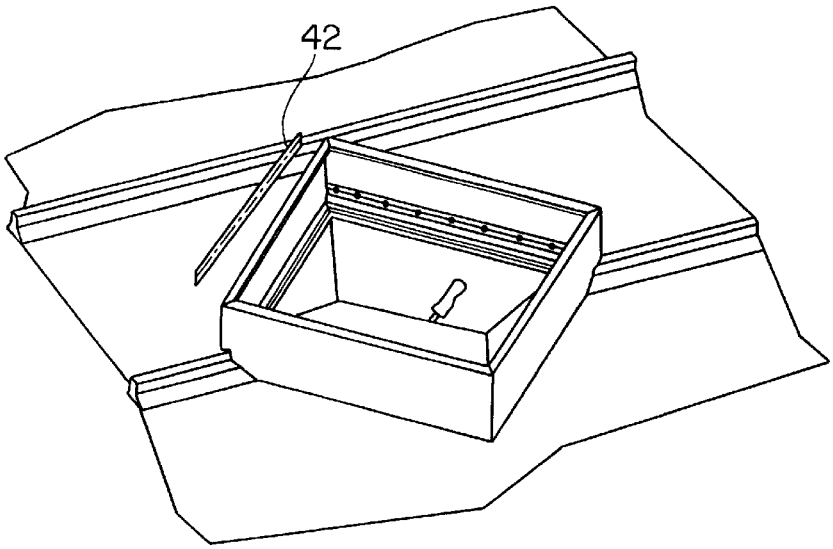
FIG. 7 shows insulation being applied to the curb unit.
Figure 8:
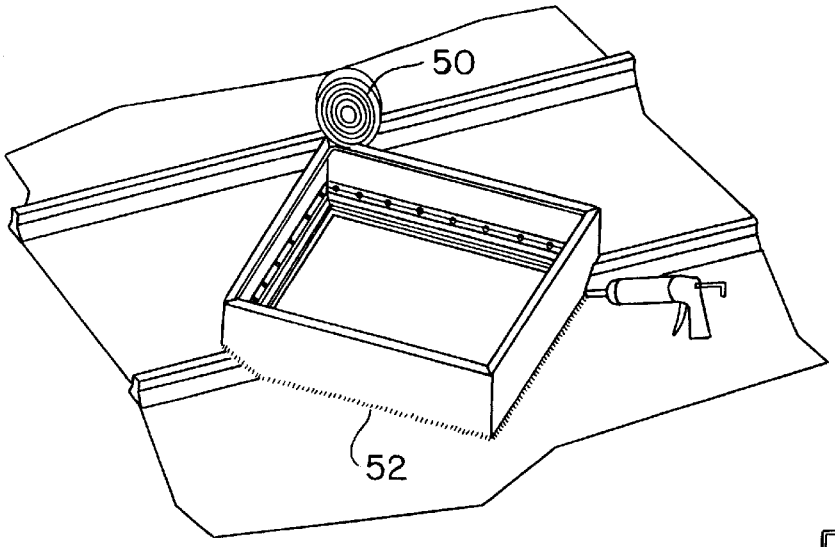
FIG. 8 shows final weather sealing being applied.
Figure 9:
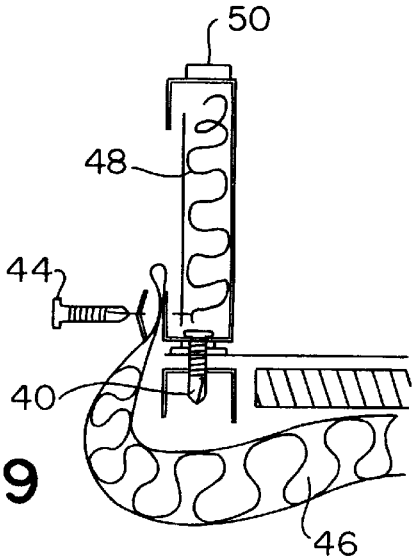
FIG. 9 is a sectional view taken on the plane 9—9 in FIG. 8.

FIG. 3 shows a worker on the roof marking the roof "R" along the inner perimeter of the curb unit, where the unit is to be installed over a seamed corrugation "C" between supporting purlins "P". Then, the unit is temporarily removed, and a hole is cut through the roof along the line marked. Reinforcing channels 34 are then attached below the roof panels, one wing of each channel lining the hole to reinforce the roof and to receive fasteners. After weather sealant (e.g., tape 36 and/or caulking 38, FIG. 5) has been applied to the perimeter of the hole, the curb unit is replaced (FIG. 6) and secured by inserting self-tapping bolts 40 through the holes 24 in the bottom flanges of the side walls, then driving them through the roof panels into the reinforcing channels 34. To complete the installation, the existing roof insulation 46 (FIG. 9) is cut as in FIG. 7, and drawn upward; the loose edges are bound by fastening trim strips 42 to the bottom flange 22 with screws 44. The volume of the side wall may be filled with insulation 48. The joint between the roof and curb unit is caulked (FIG. 8), and a gasket 50 may be applied to the top flange of the curb unit if a closure is to be installed.

Inasmuch as the invention is subject to variations and modifications, it is intended that the drawings and the foregoing description shall be interpreted as merely illustrative of the invention defined by the claims that follow.

I claim as my invention:

1. In combination with a sloping roof made of metal panels joined by seams running substantially in a downslope direction, a curb unit comprising four side walls interconnected to form a rectangle, said curb unit being mounted diagonally on the roof, with every side wall non-perpendicular to the downslope direction and two inserts one at each of diagonally opposite corners of the rectangle, each insert having a bottom surface conforming to a profile of one of said seams, and the side walls adjacent the inserts conforming to the seam profile.

2. The invention of claim 1, wherein each insert is an aluminum extrusion having a length and being cut at one end by two perpendicular planes which intersect along a line perpendicular to the length of the extrusion.

3. The invention of claim 2, wherein the four side walls are of equal length, and each of said planes is at an angle of 45° to the length of the extrusion.

* * * * *